US007894613B1

(12) United States Patent
Ong et al.

(10) Patent No.: US 7,894,613 B1
(45) Date of Patent: Feb. 22, 2011

(54) ACTIVE NOISE CONTROL RACK ENCLOSURES

(75) Inventors: Brett Cheong-Wei Ong, San Jose, CA (US); Kenneth Clayton Gross, San Diego, CA (US); Jay Kevin Osborn, Arcata, CA (US)

(73) Assignee: Oracle America, Inc., Redwood City, CA (US)

( * ) Notice: Subject to any disclaimer, the term of this patent is extended or adjusted under 35 U.S.C. 154(b) by 1313 days.

(21) Appl. No.: 11/432,754

(22) Filed: May 10, 2006

(51) Int. Cl.
*G10K 11/16* (2006.01)

(52) U.S. Cl. ..... 381/71.3; 381/71.1; 381/71.7

(58) Field of Classification Search ..... 381/71.1–71.3, 381/71.5, 71.7, 71.14, 71.8; 181/206
See application file for complete search history.

(56) References Cited

U.S. PATENT DOCUMENTS 6,825,786 B1 * 11/2004 MacDonald et al. ..... 341/144
7,282,873 B2 * 10/2007 Abali et al. ..... 318/41
7,353,908 B1 * 4/2008 French ..... 181/206
2001/0031052 A1 * 10/2001 Lock et al. ..... 381/71.7
2005/0226434 A1 * 10/2005 Franz et al. ..... 381/71.7

* cited by examiner

*Primary Examiner*—Devona E Faulk
*Assistant Examiner*—Disler Paul
(74) *Attorney, Agent, or Firm*—Martine Penilla & Gencarella, LLP

(57) ABSTRACT

Provided is an apparatus and method to control fan noise in a computer server room. An exemplary apparatus includes one or more transducers coupled to one or more walls of a plurality of system racks and one or more active noise control units, wherein the one or more active noise control units send control signals to the one or more transducers to emit a transducer acoustic wave. It also includes a microphone installed near a location in the computer server room where cooling fan noise needs to be controlled, wherein the microphone collects fan noise signals emitted from running fans on the plurality of system racks in the computer server room and sends the collected fan noise signals to the one or more active noise control units to allow the frequency and intensity of the transducer acoustic wave to be substantially equal to a frequency and an intensity of the fan noise and at about 180 degrees out of phase with the fan noise to reduce or to eliminate the fan noise.

15 Claims, 9 Drawing Sheets

ACTIVE NOISE CONTROL RACK ENCLOSURES

BACKGROUND

Computer network server system and related components are typically housed in racks configured to house and to assimilate the functions of a plurality of component devices. System racks provide efficient organization for the plurality of components for ease of access, serviceability, expandability, power distribution, cooling, etc.

These system racks generally are housed in a computer server room, which hosts many computers and servers that all require fans to keep the systems cooled. Cooling fans could come with the systems and are part of the systems. Alternatively, cooling fans could also be installed outside the systems. When cooling fans are installed outside systems, typically, they are installed in the same system racks with the systems they are designed to cool. Cooling fans emit noise (or acoustic waves) with varying wavelengths (or frequency) and intensities (or magnitudes), depending on the fan models and the running speeds. Multiple cooling fans in a computer server room running at one time may create excessive ambient noise. The ambient noise can be a high-pitched sound that sometimes prevents personnel working in the computer server room from concentrating on their work or even talking to each other. The ambient noise can grow to the point that personnel working in the room are unable to be productive.

To quiet the cooling fan noise, sound absorbing materials, such as acoustical foams, have been used in the design and construction of computer server rooms. Although acoustical foams reduce ambient noise, they do not completely remove ambient noise. In addition, acoustical foams can be quite expensive and are not practical to some computer server rooms, due to fire safety requirements or other reasons.

In consideration of the foregoing, what is needed is an efficient noise reduction apparatus and method to increase effectiveness of cooling fan noise control in computer server rooms with multiple computers, servers and cooling fans.

SUMMARY

Broadly speaking, the embodiments fill the need of reducing fan noise in computer server rooms by providing methods and apparatus to generate acoustic waves at about 180 degrees out of phase from fan noise, to effectively cancel the fan noise. It should be appreciated that the present invention can be implemented in numerous ways, including as a system and a method. Several inventive embodiments of the present invention are described below.

In one embodiment, a computer server room with controlled cooling fan noise is provided. It includes one or more system racks, wherein the one or more system racks have a plurality of systems and a plurality of cooling fans to cool the plurality of systems, and the cooling fans emit fan noise while running. It also includes one or more transducers coupled to one or more walls of the one or more system racks, wherein at least one of the one or more transducers emit transducer acoustic waves to reduce or essentially to eliminate the fan noise.

In another embodiment, a system to control fan noise in a computer server room is provided. It includes one or more transducers coupled to one or more walls of a plurality of system racks and one or more active noise control units, wherein the one or more active noise control units send control signals to the one or more transducers to emit a transducer acoustic wave. It also includes a microphone installed near a location in the computer server room where cooling fan noise needs to be controlled, wherein the microphone collects fan noise signals emitted from running fans on the plurality of system racks in the computer server room and sends the collected fan noise signals to the one or more active noise control units to allow the frequency and intensity of the transducer acoustic wave to be substantially equal to a frequency and an intensity of the fan noise and at about 180 degrees out of phase with the fan noise to reduce or essentially to eliminate the fan noise.

In yet another embodiment, a method of reducing a cooling fan noise in a computer server room is provided. It includes using a microphone, placed near a location where cooling fan noise needs to be controlled, to collect cooling fan noise signals, wherein the cooling fan noise comes from running cooling fans on system racks which have systems that are operating. It also includes sending cooling fan noise signals to one or more active noise control units, and analyzing cooling fan noise signals to determine a phase, an intensity and a frequency of the cooling fan noise signals. It further includes sending control signals from the one or more active noise control units to one or more transducers to emit a transducer acoustic wave, and emitting the transducer acoustic wave from the one or more transducers to reduce the cooling fan noise.

BRIEF DESCRIPTION OF THE DRAWINGS

The present invention will be readily understood by the following detailed description in conjunction with the accompanying drawings, and like reference numerals designate like structural elements.

DETAILED DESCRIPTION

The embodiments described below fill the need of reducing fan noise in computer server rooms by providing methods and apparatus to generate about 180 degrees out of phase acoustic waves to cancel fan noise. The apparatus and methods provide efficient noise reduction to increase the effectiveness of noise control. It will be obvious, however, to one skilled in the art, that the present invention may be practiced without some or all of these specific details. In other instances, well known process operations have not been described in detail in order not to unnecessarily obscure the present invention.

Figure 1A:
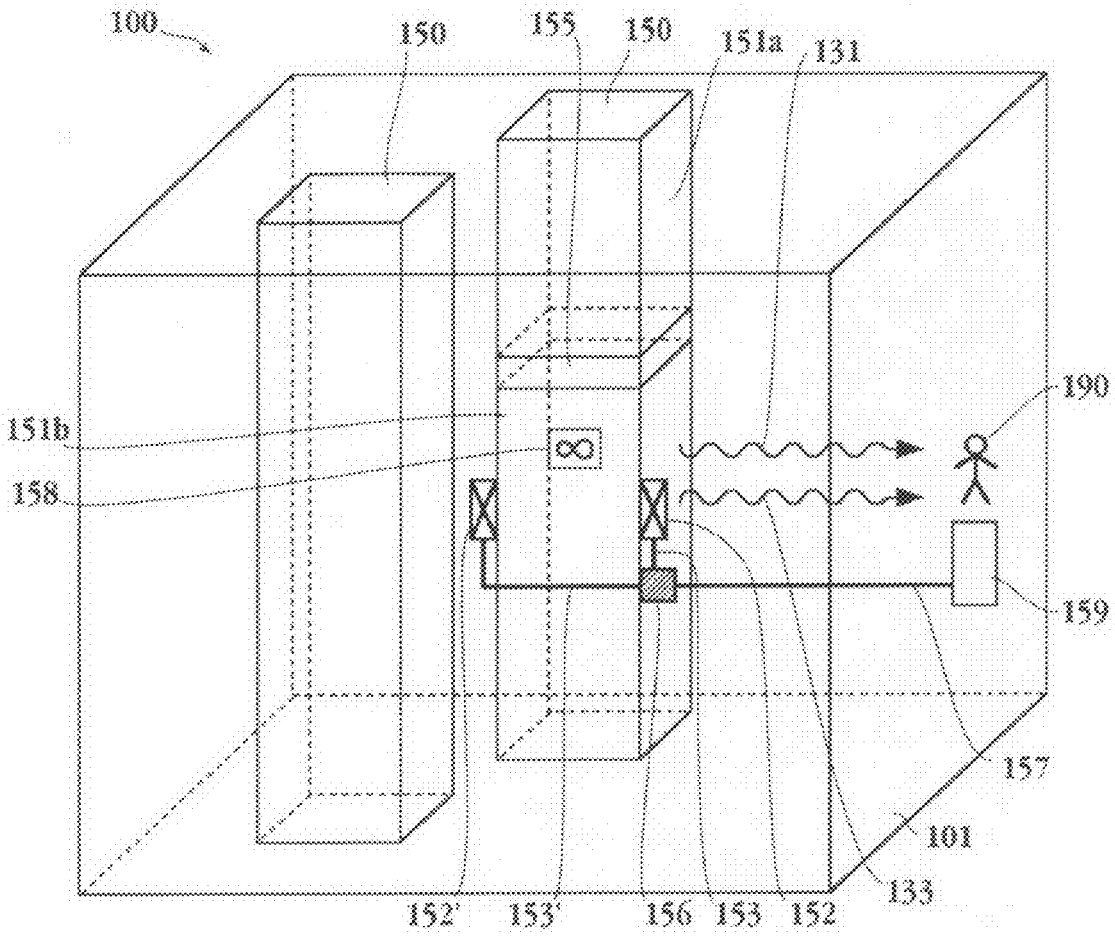
FIG. 1A shows a computer server room with one or more server racks with an embodiment of a noise control apparatus.

FIG. 1A shows an exemplary computer server room 100 with multiple system racks 150 (only two exemplary system racks are shown). System racks 150 house multiple servers and/or computers. Servers and computers can also be described as systems. On each of the system racks 150, there are multiple systems 155 (only one is shown) and multiple cooling fans 158 (only one is shown). The cooling fans 158 on system rack 150 can run at the same speed or different speeds to generate noise at the same or different pitches (or wavelengths). Alternative examples may have the fans 158 directly connected to the systems 155. For example, the fans 158 can be integrated at the front or back of a system 155. Fan noise is composed of sound waves (or acoustic waves), which can be represented by periodic and random wave functions. If the cooling fans are of same model and are running at the same speed, the pitches (or periods, or wavelengths, or frequencies) and the intensities of the fan noise should be the same or very close. In contrast, if the cooling fans are of different models or running at different speeds, the frequencies and the intensities of the fan noise would be different.

If cooling fans 158 come with systems 155, the cooling fans 158 are typically turned on when the systems 155 are running. If the cooling fans 158 are outside the systems 155, the number of cooling fans that are turned on is typically proportional to the number of running systems 155. Typically, the cooling fans near the running systems 155 are turned on first to effectively cool the running systems 155.

For example, cooling fans 158 emit a fan noise, represented by an acoustic wave (or waves) 131. The fan noise 131 from the cooling fans 158 in the computer server room 100 reduces the productivity of the personnel 190 near wall 101 in the computer server room 100. To reduce fan noise around personnel 190, in one embodiment, one or more transducers 152 can be placed on system racks 150. Typically, system racks 150 have enclosures. In one embodiment, system racks 150 have enclosures made of metal sheet(s) covering at least the sidewalls $\mathbf{151}_a$, $\mathbf{151}_b$ of the system racks 150. The transducers 152 can be placed on or connected to the metal sheet sidewalls $\mathbf{151}_a$, $\mathbf{151}_b$ to enable the emission of transducer acoustic wave (or waves) 133 at about 180 degrees out of phase with the acoustic wave 131. The transducer acoustic wave 133 emitted from the transducers 152 is configured to be at almost the same frequency and intensity (or magnitude) as the fan acoustic wave 131 of the fan noise in order to substantially cancel the fan acoustic wave (or fan noise) 131. Due to canceling effect of the transducer acoustic wave 133, fan acoustic wave 131 can be greatly reduced or essentially eliminated. In one embodiment, the transducers 152 are acoustic drivers. The metal sheet sidewalls $\mathbf{151}_a$, $\mathbf{151}_b$ functions as diaphragms (or speakers) for the acoustic drivers.

In one embodiment, if the fan noise from multiple running fans have different frequencies (wavelengths), the fan acoustic wave 131 is composed of multiple acoustic waves of different frequencies and intensities and is represented by a complex periodic function. Under such a circumstance, one or more transducers 152 can be configured to emit transducer acoustic wave 133 with about 180 degrees out of phase with the fan acoustic wave 131 and with frequencies and intensities matching the acoustic wave 133 to effectively cancel or reduce the fan noise(s).

In one embodiment, transducers 152 are made using piezoelectric crystals. Under alternating electric fields, the crystals vibrate at the frequency of the AC fields to generate acoustic waves (or sound waves). The thickness of the piezoelectric crystals and the frequencies of the applied AC fields determine the frequencies and intensities of the acoustic waves the transducers generate. In another embodiment, transducers 152 are made using electromagnetic drivers.

In order to generate correct intensity and frequency of transducer acoustic wave 133 to cancel the fan acoustic wave 131 emitted by the cooling fans 158, in one embodiment, the frequency and intensity of the acoustic wave heard by the personnel 190 can be collected by a microphone 159, installed near personnel 190. In one embodiment, the fan acoustic wave 131 detected by the microphone 159 is transmitted through a signal cable 157 to one or more active noise control units 156, which can analyze the intensity (or intensities) and frequency (or frequencies) of the detected fan acoustic wave 131. In another embodiment, the microphone 159 transmits detected signals to active noise control units through a wireless device. In one embodiment, the active noise control units 156 then send controlling signal through a signal cable 153 to transducers 152 to emit a transducer acoustic wave 133 (or waves) that is substantially at about 180 degrees out of phase with the fan acoustic wave 131. In another embodiment, the active noise control units 156 send controlling signals through a wireless device to transducers 152. The transducer acoustic wave 133 is at about the same intensity and frequency as the fan acoustic wave 131 to effectively cancel the fan acoustic wave 131.

In one embodiment, the active noise control unit 156 is coupled to multiple transducers, such as transducers 152 and 152'. The active noise control unit 156 may only instruct some of the transducers, such as transducers 152, to emit transducer acoustic waves 133, while leaving other transducers, such as transducers 152', un-triggered.

Figure 1B:
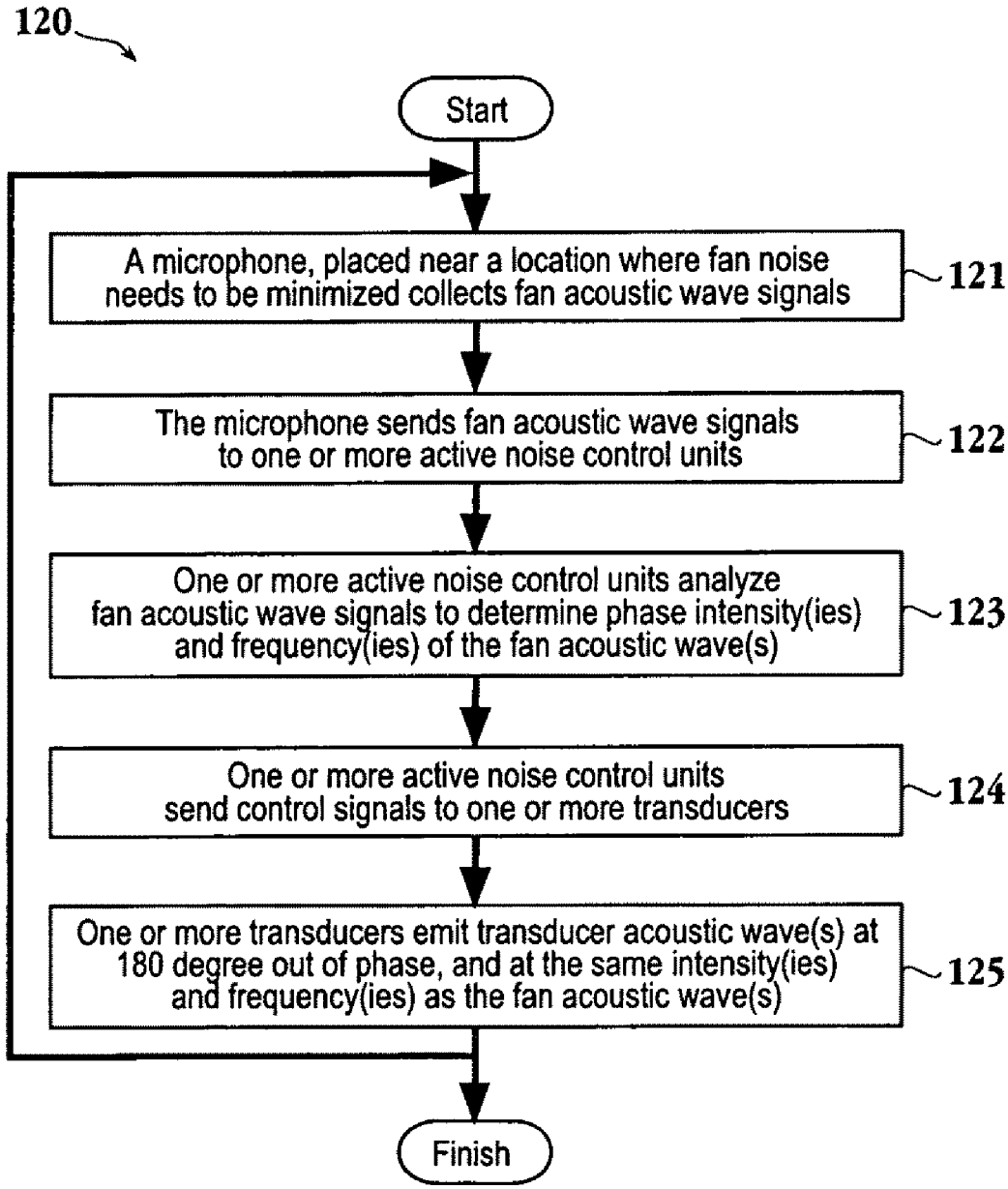
FIG. 1B shows an embodiment of a process flow to reduce cooling fan noise.

FIG. 1B shows an embodiment of a process flow 120 for fan noise reduction in a computer server room. The process starts at operation 121 by using a microphone, placed near a location where fan noise needs to be minimized, to collect fan acoustic wave (or fan noise) signals. At operation 122, the microphone sends data of fan acoustic wave signals to one or more active noise control units. At operation 123, the one or more active noise control units analyze fan acoustic wave signals to determine phase, intensity (ies) and frequency (ies) of the fan acoustic wave(s). At operation 124, the one or more active noise control units send control signals to one or more transducers. At operation 125, one or more transducers, after receiving controlling signals from the one or more active noise control units, emit transducer acoustic wave(s) at about 180 degrees out of phase, at about the same intensity (ies), and at about the same frequency (ies) as the fan acoustic wave(s) to cancel, to reduce or essentially to eliminate the fan acoustic wave(s).

Figure 1C:
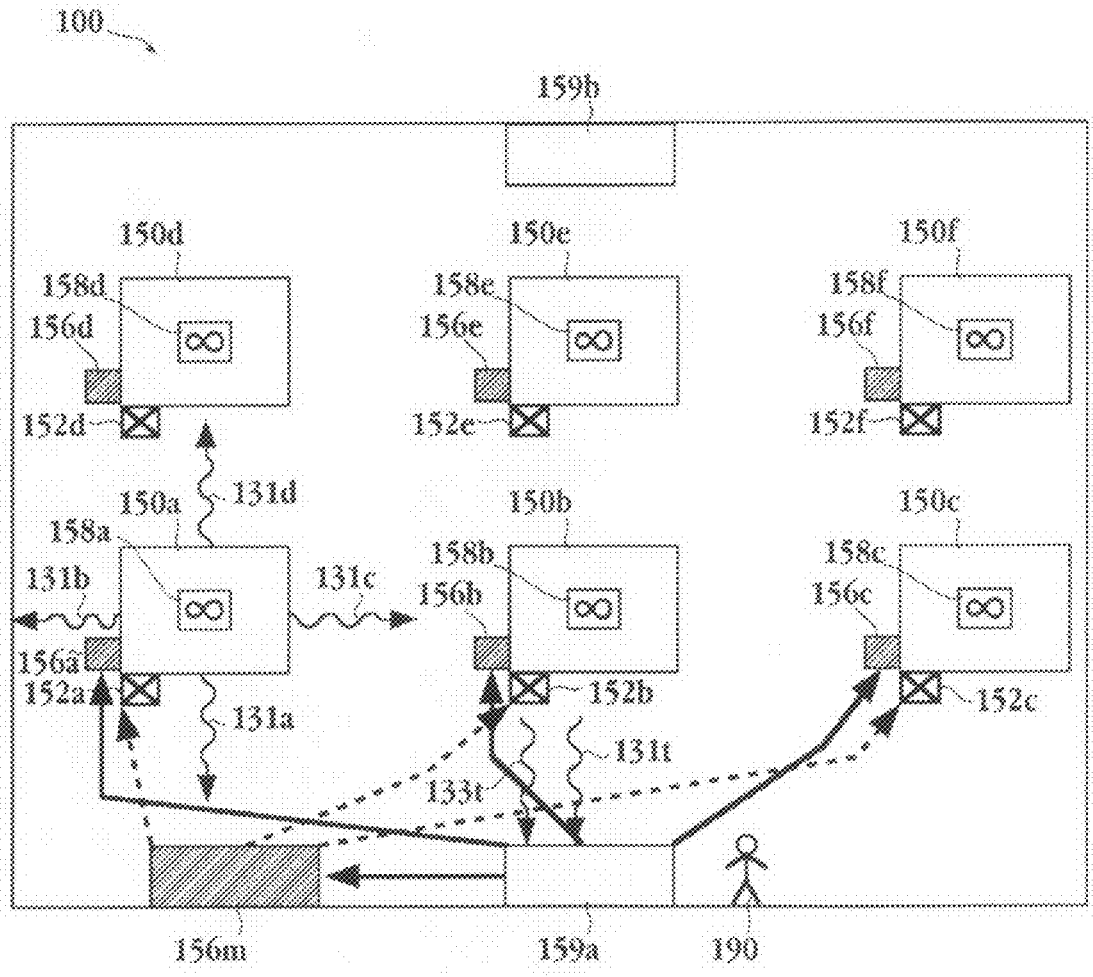
FIG. 1C shows a top view of a computer server room with multiple server racks with an embodiment of a noise control apparatus.

FIG. 1C shows an embodiment of a top view of computer server room 100. Server room 100 is filled with multiple system racks, $\mathbf{150}_a$, $\mathbf{150}_b$, . . . , $\mathbf{150}_f$. For example, the cooling fans $\mathbf{158}_a$ on system rack $\mathbf{150}_a$ can emit fan acoustic waves $\mathbf{131}_a$, $\mathbf{131}_b$, $\mathbf{131}_c$, and $\mathbf{131}_d$ in all directions. Fan acoustic waves $\mathbf{131}_a$, $\mathbf{131}_b$, $\mathbf{131}_c$, and $\mathbf{131}_d$ are accumulated sound waves emitted by the cooling fans $\mathbf{158}_a$ on system rack $\mathbf{150}_a$. Similarly, other system racks can also emit fan acoustic waves similar to waves $\mathbf{131}_a$, $\mathbf{131}_b$, $\mathbf{131}_c$, and $\mathbf{131}_d$. There is a microphone $\mathbf{159}_a$ that can collect accumulated fan acoustic wave 131, near personnel 190. The fan acoustic wave $\mathbf{131}_t$ detected by the microphone $\mathbf{159}_a$ can be communicated to one or more active noise control units, such as $\mathbf{156}_a$, . . . , $\mathbf{156}_f$, on system racks, such as $\mathbf{150}_a$, . . . , $\mathbf{150}_f$, that have running fans, such as $\mathbf{158}_a$, . . . , $\mathbf{158}_f$. The active noise control units, such as $\mathbf{156}_a$, . . . , $\mathbf{156}_f$, receives the signals from the microphone $\mathbf{159}_a$, and then analyzes accumulated fan acoustic wave (or waves) $\mathbf{131}_t$ to determine its phase, frequency (or frequencies) and intensity (or intensities). The active noise control units, $\mathbf{156}_a$, . . . , $\mathbf{156}_f$, then send out control signals to transducers, such as $\mathbf{152}_a$, . . . , $\mathbf{152}_f$, on system racks, such as $150_a, \ldots, 150_f$, to emit canceling transducer acoustic waves, totaled to be a total transducer acoustic wave $133_t$, at about 180 degrees out of phase and at the same frequency and intensity as the acoustic wave detected by the microphone $159_a$. With the emission of the total transducer acoustic wave $133_t$, the fan acoustic wave $131_t$ detected by the microphone $159_a$ and personnel 190 would be greatly reduced or essentially eliminated. The personnel 190 working near microphone $159_a$ would be less or almost not bothered by the fan noise and be more productive and efficient.

If multiple server racks, such as system racks $150_a$, $150_b$, and $150_c$, have running fans, such as $158_a$, $158_b$, and $158_c$, microphone $159_a$ can be configured to transmit the detected acoustic wave signals to multiple active noise control units, such as $156_a$, $156_b$, and $156_c$. In one embodiment, the multiple noise control units, such as $156_a$, $156_b$, and $156_c$, are configured to be informed of the status of all active server racks. After analyzing the phase, the intensity and the frequency of the detected acoustic wave, the multiple active noise control units, such as $156_a$, $156_b$, and $156_c$, send control signals to transducers, such as $152_a$, $152_b$, and $152_c$ to allow some or all transducers, $152_a$, $152_b$, $152_c$, to emit canceling acoustic wave(s), totaled to be equal to the intensity and frequency of the detected acoustic wave, but at about 180 degrees out of phase to cancel the detected acoustic wave.

In another embodiment, the microphone $159_a$ can transmit the signal of the detected acoustic wave to a main active noise control unit $156_m$. The main active noise control unit $156_m$ determines the phase, the intensity and the frequency of the detected acoustic wave and sends control signals to transducers, $152_a$, $152_b$, or $152_c$, on active server racks (or server racks that have running fans) to emit canceling acoustic waves, which when added together equal to the intensity and frequency of the detected acoustic wave, but at about 180 degrees out of phase to cancel the detected acoustic wave. In yet another embodiment, the main active noise control unit $156_m$ sends control signals to one or more transducers, such as transducers $152_b$, $152_c$, that are near the personnel 190 to emit canceling acoustic wave(s), with intensity and frequency equal to the intensity and frequency of the detected acoustic wave, but at 180 degrees out of phase to cancel the detected acoustic wave.

Figure 1D:
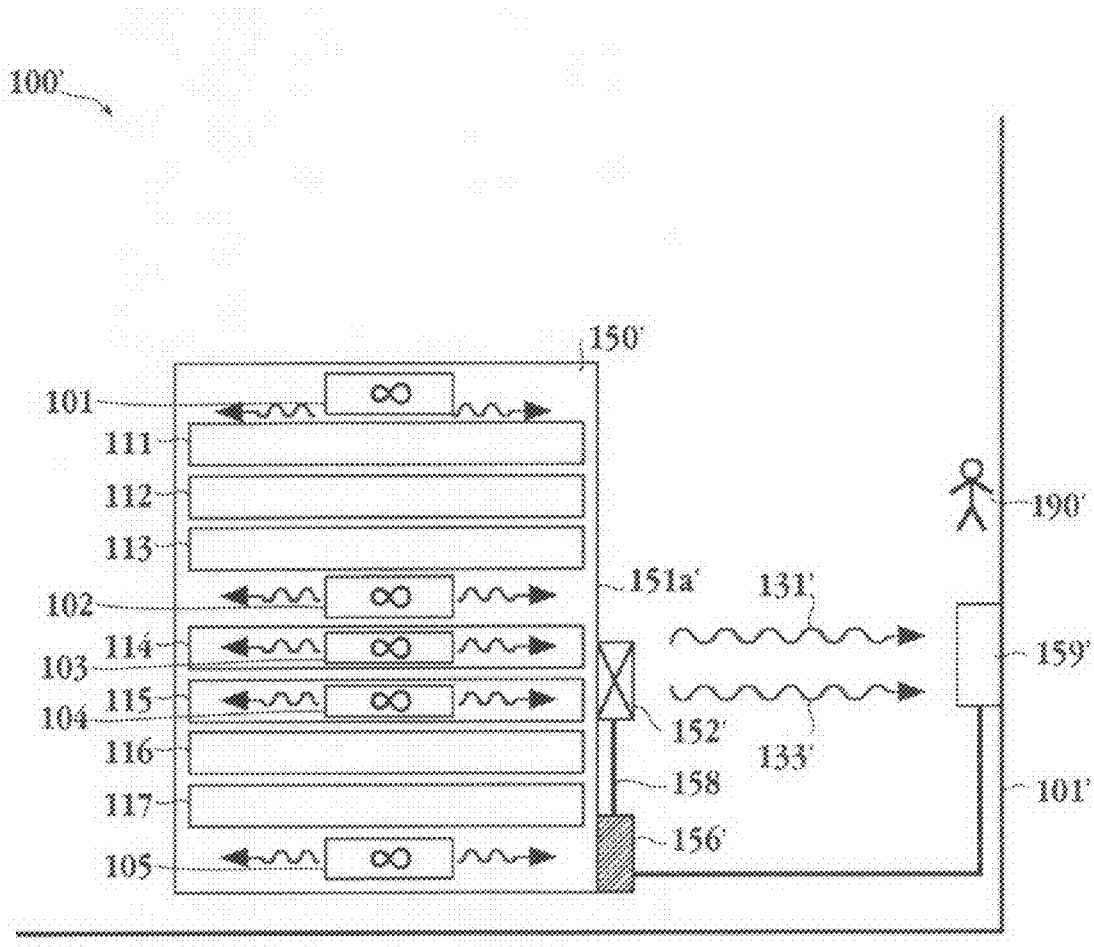
FIG. 1D shows a server rack with multiple servers and multiple cooling fans and an embodiment of a noise control apparatus.

FIG. 1D shows a side view of an embodiment of a server room 100' with one or more system racks 150'. The system rack 150' has fans 101, 102, 103, 104, and 105. The system rack 150' also has servers or other types of computer systems 111, 112, 113, 114, 115, 116, and 117. Fan 103 resides on server 114 and fan 104 resides on server 115. Typically, fans residing on servers run when the servers are on. Fans that are not associated with any particular servers are usually turned on when needed. As the number of running (or operating) servers increases, the number of fans that are turned on also increases to accommodate the need for cooling of the servers.

In one embodiment, the cooling fan identification and status, such as running or not, and fan tachometer data (for phase information and running speed), are transmitted to an active noise control unit 156'. With experimental correlation between the fan running speed and fan noise acoustic wave, the active noise control unit 156' can determine the phase, the frequency and intensity of the fan acoustic wave based on the fan identification and status information provided. The active noise control unit 156' determines the phase, frequency and intensity of the overall acoustic wave 131' emitted by the running fans based on the correlation table between fan speed and fan noise acoustic wave and mathematical addition of acoustic waves. The active noise control unit 156' then sends control signals to one or more transducers 152' on server 150' to emit canceling transducer acoustic wave(s) 133' that is at about 180 degrees out of phase with fan acoustic wave 131' generated by the running fans and at about the same intensity and about the same frequency (or wavelength) to ensure the acoustic wave 131' is largely or essentially eliminated. The total fan acoustic wave 131' could be a complicated acoustic wave form that has multiple intensities and frequencies; therefore, the transducer acoustic waves 133' generated need to substantially match the fan acoustic wave 131' but at about 180 degrees out of phase.

In another embodiment, the microphone 159' on the wall 101' near personnel 190' is activated to collect fan acoustic wave signals to confirm that acoustic wave 131' is largely or essentially eliminated. If not, microphone 159' provides feedback to be used to tune the active noise control unit 156', which, after tuning, sends controlling signals to transducers 152' again, to reduce the acoustic wave 131' to largely or essentially non-existent. The feedback process can be an ongoing process for the microphone 159' to constantly check on the status of noise reduction.

Figure 1E:
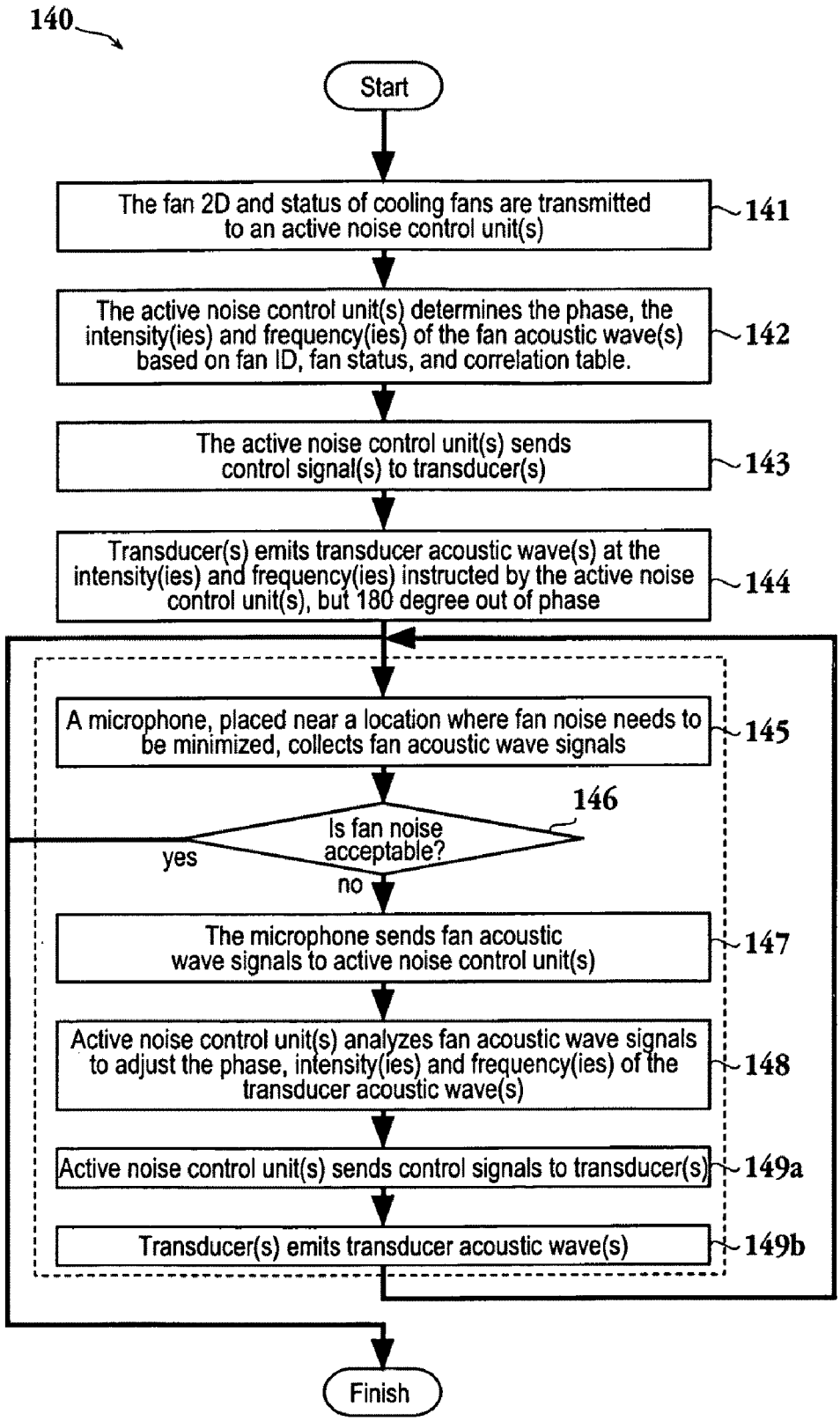
FIG. 1E shows another embodiment of a process flow to reduce cooling fan noise.

FIG. 1E shows an embodiment of a process flow 140 for fan noise reduction in a computer server room. The process starts at operation 141 when the fan identification (ID) and status of cooling fans are transmitted to an active noise control unit(s). At operation 142, the active noise control unit(s) determines the phase, the intensity (or intensities) and the frequency (or frequencies) of the fan acoustic wave(s) based on fan ID, fan status, and a correlation table that correlates fan speed to fan noise (or fan acoustic wave). At operation 143, the active noise control unit(s) sends control signals to transducer(s). The control signals instruct the transducer(s) what phase, intensity and frequency of transducer acoustic wave(s) to emit in order to cancel the fan acoustic wave(s). At operation 144, the transducer(s) emits transducer acoustic wave(s) at the phase, intensity and frequency instructed by the active noise control unit(s) to cancel the fan acoustic wave. Ideally, if the correlation table established is correct in establishing the relationship between the fan speed and fan noise, the process should proceed to "finish", since the fan noise would be greatly reduced or essentially eliminated. However, if the correlation table is not accurate enough, additional monitoring and adjustment might be needed.

The process then proceeds to operation 145. At operation 145, a microphone, placed near a location where fan noise needs to be minimized, is used to collect fan acoustic wave signals. At the following operation 146, the collected fan acoustic wave signals are compared to the fan noise limit to determine if the fan noise is within acceptable range. If the answer is "yes", the process goes to the finish operation. If the answer is "no", the process proceeds to operation 147. At operation 147, the microphone sends fan acoustic wave signals to active noise control unit(s). At the following operation 148, the active noise control unit(s) analyzes fan acoustic wave signals received from the microphone to adjust the phase, the intensity and the frequency of the transducer acoustic wave(s). At the same time, the correlation table can also be modified to reflect the residual fan noise collected by the microphone. Afterwards, the active noise control unit(s) sends control signals to transducer(s) at operation 149*a*. At operation 149*b*, transducer(s) emits transducer acoustic wave(s) according to instructions from the active noise control unit(s). After operation 149*b*, the process goes back to operations following 145 to check if there is residual fan noise that is beyond control limit. The checking process continues until the fan noise is within acceptable limit at operation 146.

Figure 2A:
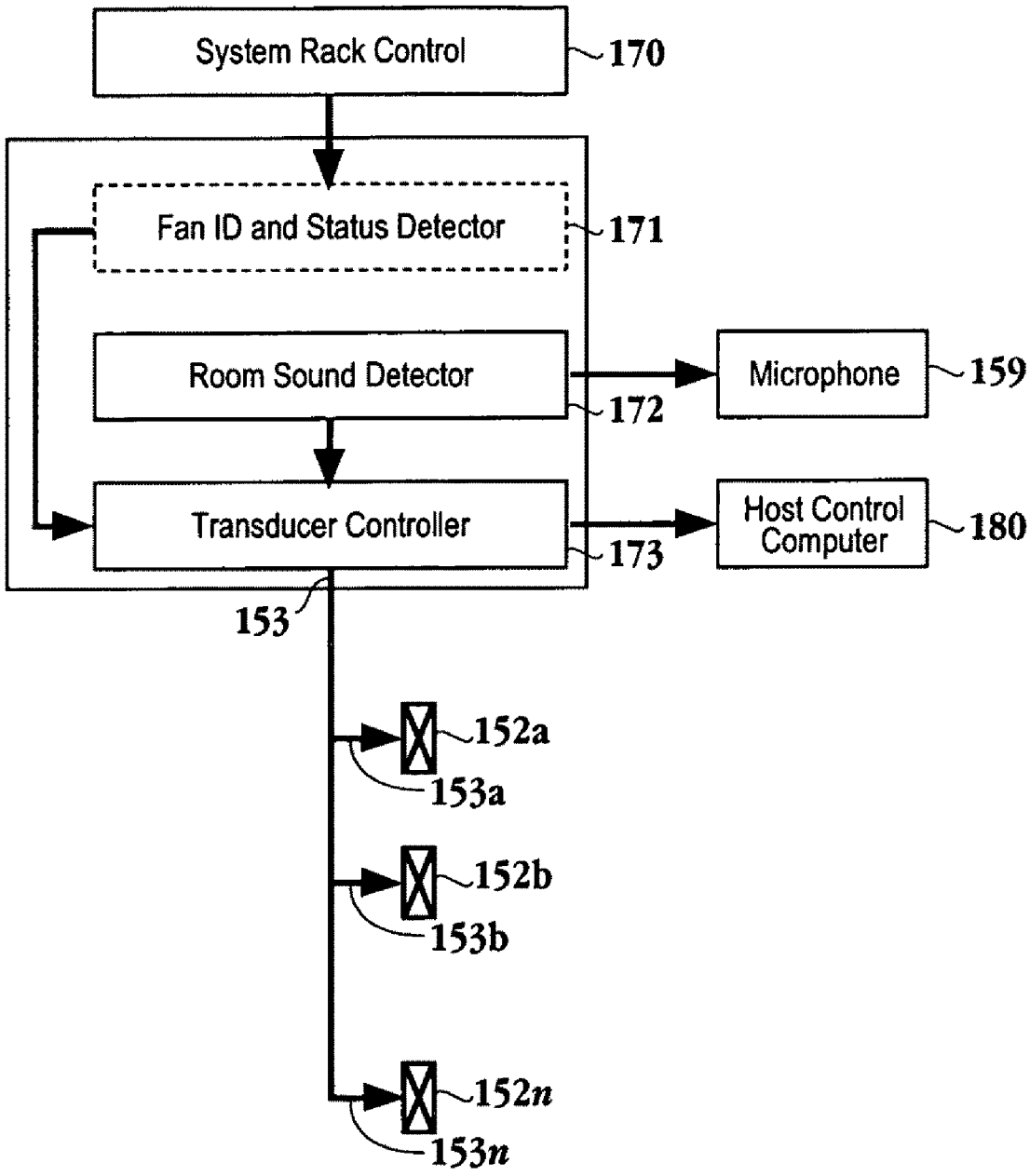
FIG. 2A shows an embodiment of an active noise control unit.

FIG. 2A shows an embodiment of an active noise control unit 156. The unit 156 includes a room sound detector 172 that detects the sound signals received by the microphone 159. The room sound detector 172 analyzes the sound signal to determine the phase, the frequency (or wavelength) and the intensity of the sound wave (or acoustic wave) detected by microphone 159. The phase, frequency and intensity data are provided to a transducer controller 173 in the active noise control unit 156. In one embodiment, the transducer controller 173 issues control signals to one or more transducers, $\mathbf{152}_a$, $\mathbf{152}_b$, . . . , $\mathbf{152}_n$, to emit transducer acoustic wave(s) at about 180 degrees out of phase with the acoustic wave emitted by the cooling fans and detected by the microphone 159. The acoustic waves emitted by participating transducers, $\mathbf{152}_a$, $\mathbf{152}_b$, . . . , $\mathbf{152}_n$, add up to be equal to the intensity and frequency of the acoustic wave detected by the microphone 159 to eliminate much or most of the acoustic wave(s) emitted by the fans.

In another embodiment, the active noise control unit 156 includes a fan ID and status detector 171, that can detect which fan has been turned on and at what speed the fan is running. The fan ID and status information could come from a system rack controller 170. Based on the fan ID and status information, the detector 171 can calculate the phase, frequency and intensity of the running fans and send the information to the transducer controller 173. The transducer controller 173 then issues control signals to one or more transducers, $\mathbf{152}_a$, $\mathbf{152}_b$, . . . , $\mathbf{152}_n$, to emit acoustic wave(s) at about 180 degrees out of phase with the acoustic wave emitted by the fans and detected by the microphone 159. The acoustic waves emitted by participating transducers, $\mathbf{152}_a$, $\mathbf{152}_b$, . . . , $\mathbf{152}_n$, add up to be equal to the intensity and frequency of the acoustic wave detected by the microphone 159 to eliminate much or most of the acoustic wave(s) emitted by the fans.

In another embodiment, the active noise control unit 156 includes a fan ID and status detector 171, a room sound detector 172, and a transducer controller 173. Similar to the embodiment described above, the fan unit and speed detector 171 receives inputs from a system rack controller 170 to determine which fans have been turned on and at what speeds the fans are running, and send the phase, frequency (or frequencies) and intensity (or intensities) information of the running fans to the transducer controller 173 to control transducers $\mathbf{152}_a$, . . . , $\mathbf{152}_n$ to emit transducer acoustic wave(s) to cancel the fan acoustic wave(s). The room sound detector 172 receives sound signals collected by microphone 159 and the room sound detector 172 and the microphone 159 provides a feedback of the effectiveness of the transducers in canceling the acoustic wave(s) emitted by the running fans. If the transducer acoustic wave(s) emitted by transducers, under the direction of the transducer controller 173, is not effective in eliminating (or canceling) the acoustic wave(s) generated by the running fans, the microphone 159 would pick up sound signals with substantial intensity, which can be analyzed by the room sound detector 172 to provide the phase, intensity and frequency information to the transducer controller 173 to adjust the controlling signals to the transducers. The feedback of the microphone 159 can be continued until the fan noise is largely or essentially eliminated.

Figure 2B:
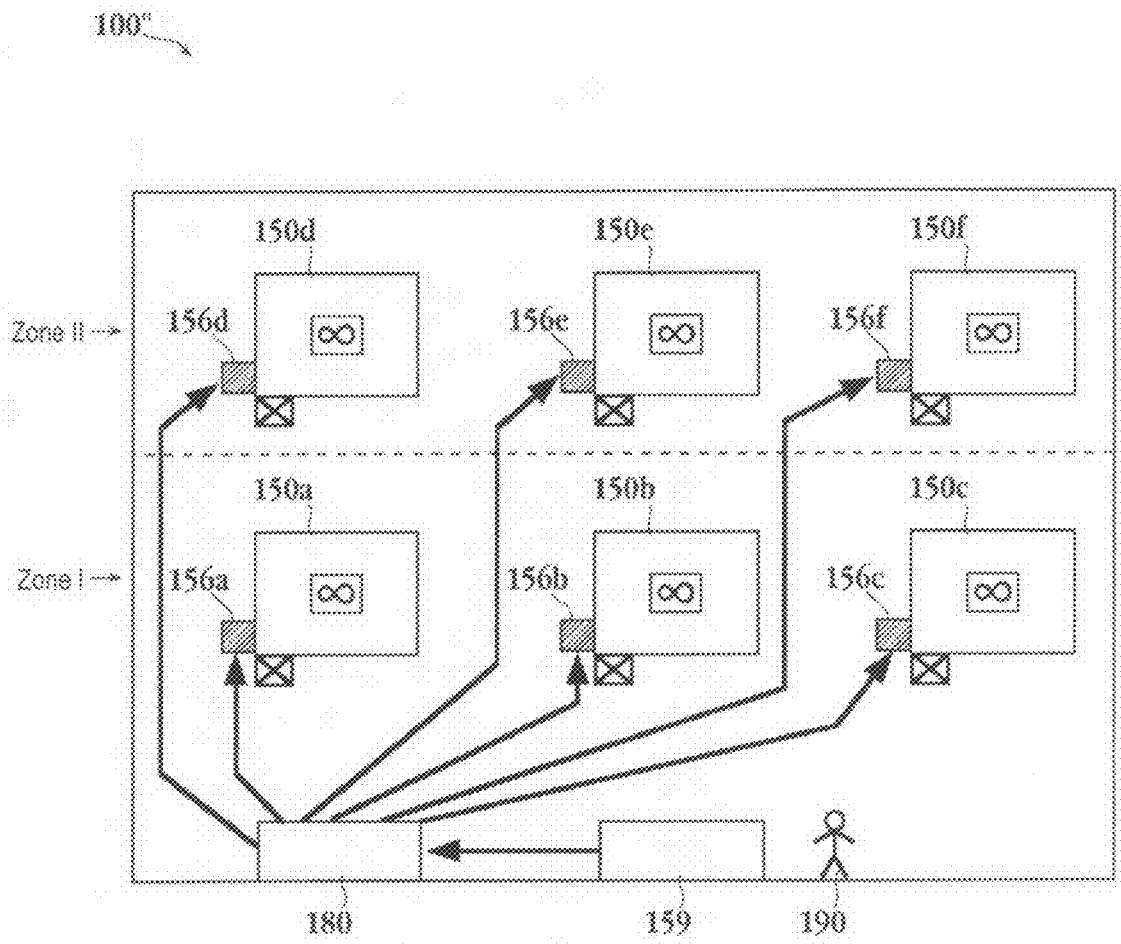
FIG. 2B shows an embodiment of an active control unit applied to a computer server room.

In addition, the transducer controller 173 can receive instruction from a host control computer 180. The host control computer can be coupled to multiple transducer controllers 173 in multiple system racks, such as $\mathbf{150}_a$, . . . $\mathbf{150}_f$ in computer server room 100" (see FIG. 2B). In one embodiment, the system racks can be assigned to different zones, such as zone I, and zone II. The active noise control units 156 on system racks in different zones can be activated by the host control computer 180 to control noise level in the server room. The host control computer 180 is coupled to all system racks $\mathbf{150}_a$, . . . $\mathbf{150}_f$, and active noise control units $\mathbf{156}_a$, . . . , $\mathbf{156}_f$, on all system racks $\mathbf{150}_a$, . . . $\mathbf{150}_f$.

Figure 3:
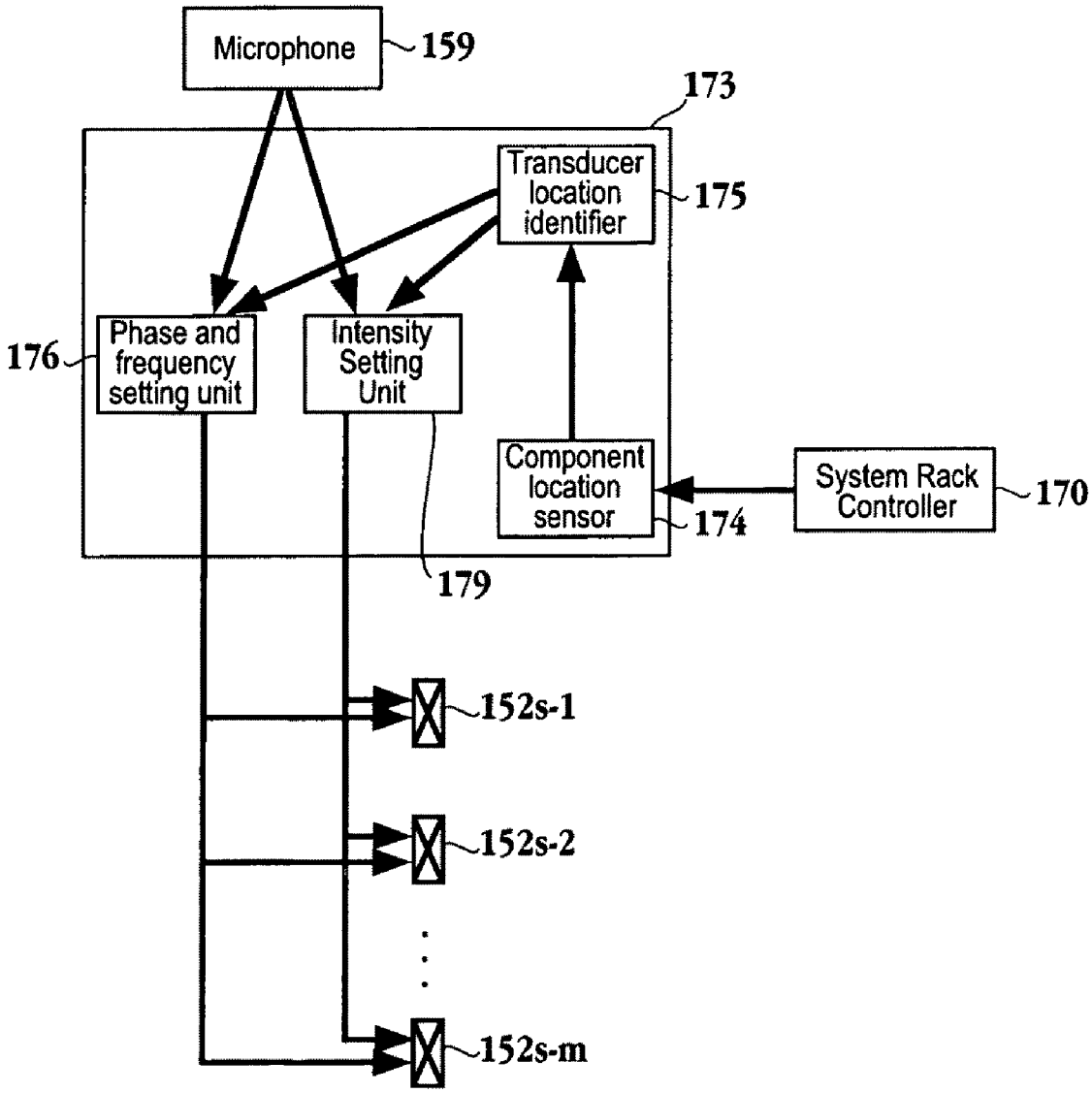
FIG. 3 shows an embodiment of a transducer controller.

FIG. 3 shows an embodiment of a transducer controller 173, which receives inputs, directly or indirectly, from a system rack controller 170. The system rack controller 170 provides information regarding the location and status of the components, such as servers, computers, and fans, on the system rack 150 to component location sensor 174 on transducer controller 173. The components' location sensor 174, on transducer controller 173, communicates the locations and status of the components to the transducer location identifier 175 on the controller 173. The transducer location identifier 175, based on the location and status of components, determines which transducers need to be activated to emit canceling acoustic wave(s). The transducer location identifier 175 communicates the transducers selected $\mathbf{152}_{s-1}$, . . . , $\mathbf{152}_{s-m}$, to the phase and frequency setting unit 176 and the intensity setting unit 177. The phase and frequency setting unit 176 and the intensity setting unit 177, based on the inputs they received from the transducer location identifier 175 and the microphone 159 determine the frequencies and intensities of each of the selected transducers $\mathbf{152}_{s-1}$, . . . , $\mathbf{152}_{s-m}$. In one embodiment, transducer controller 173 can be implemented in firmware. In another embodiment, transducer controller can be implemented using a digital signal processor.

As described above, the transducers 152 are installed on the walls $\mathbf{151}_a$, $\mathbf{151}_b$ of the system racks 150. One of the benefits of installing the transducers 152 on the walls of the system racks 150 is that as more system racks 150 are put into the computer server room 100, more transducers are available to emit canceling acoustic waves. However, it is not necessary to install transducers on the walls of the system racks. Transducers can also be installed on the walls of the computer server room or on another object in the room.

Figure 4:
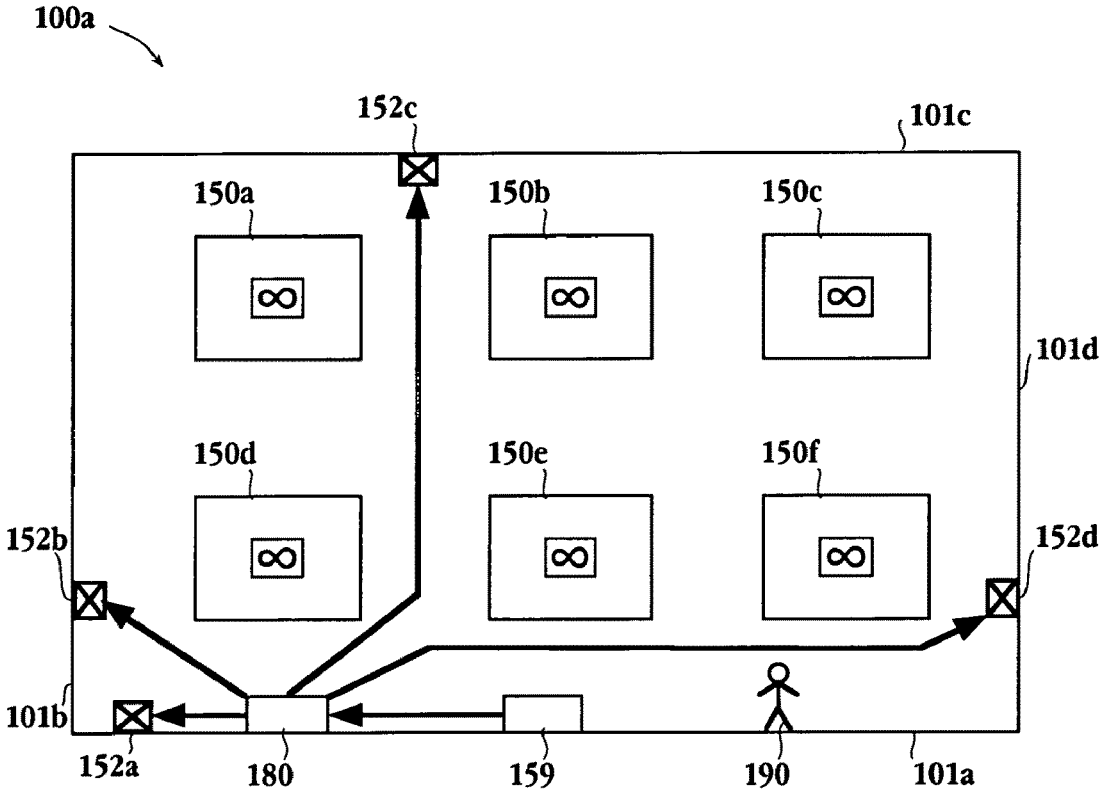
FIG. 4 shows a top view of a computer server room with multiple server racks with an embodiment of a noise control apparatus.

FIG. 4 shows an another embodiment of a computer server room 100*a* with multiple system racks $\mathbf{150}_a$, . . . $\mathbf{150}_f$, in room 100A. Instead of installing transducers on the system racks $\mathbf{150}_a$, . . . $\mathbf{150}_f$, one or more transducers $\mathbf{152}_a$, . . . , $\mathbf{152}_d$ are installed on the walls $\mathbf{101}_a$, . . . $\mathbf{101}_d$ of computer server room 100*a*. The microphone 159 collects fan noise signals and transmits the signals to a host computer 180. The host computer 180 controls the transducers $\mathbf{152}_a$, . . . , $\mathbf{152}_d$, to emit canceling transducer acoustic waves.

The transducers, either mounted on the system racks or on the walls of computer server room, can respond to an increase or decrease in the number of system racks and running fans easily. The transducers are also more adaptable to changes in the computer server rooms, such as change in the location the personnel 190 works. To accommodate to this change, one might only need to move the location of the microphone.

Although a few embodiments of the present invention have been described in detail herein, it should be understood, by those of ordinary skill, that the present invention may be embodied in many other specific forms without departing from the spirit or scope of the invention. Therefore, the present examples and embodiments are to be considered as illustrative and not restrictive, and the invention is not to be limited to the details provided therein, but may be modified and practiced within the scope of the appended claims.

What is claimed is:

1. A computer server room with a controlled cooling fan noise, comprising:

one or more system racks, wherein the one or more system racks have a plurality of systems and a plurality of cooling fans to cool the plurality of systems, the cooling fans emit fan noise while running; and one or more transducers coupled to one or more walls of the one or more system racks, the coupling configured to enable the one or more walls to function as diaphragms for the one or more transducers;

at least one microphone installed near a location where fan noise needs to be controlled; and one or more active noise control units, wherein the at least one microphone collects fan noise signals and then sends the collected signals to the one or more active noise control units, the one or more active noise control units send control signals to at least one of the one or more transducers to emit transducer acoustic waves to reduce or to eliminate the fan noise;

wherein the one or more active noise control units send control signals to the at least one transducer to emit transducer acoustic waves at about 180 degrees out of phase with the fan noise and at an intensity and a frequency substantially equal to the fan noise;

wherein each of the one or more transducers comprises a fan identification and speed detector that determines which fan is running and at what speed, a room sound detector to detect the sound signals received by the microphone, and a transducer controller to issue control signals to the one or more transducers;

wherein the transducer controller comprises a component location sensor, a transducer location identifier, an intensity setting unit, and a phase and frequency setting unit, wherein the component location sensor communicates the locations and status of components on the system racks to the transducer location identifier, the transducer location identifier selects which transducers need to be activated based on the locations and status of components and communicates which transducers have been selected to the intensity setting unit and the phase and frequency setting unit, the intensity setting unit, and the phase and frequency setting unit receive fan noise signals from the microphone and which transducers have been selected from the transducer location identifier, send controlling signals to the selected transducers to emit acoustic waves to reduce or to eliminate fan noise.

2. The computer server room of claim 1, wherein the one or more active noise control units analyze the collected fan noise signals sent by the microphone to determine the phase, frequency and intensity of the fan noise.

3. The computer server room of claim 2, wherein the analysis of the collected fan noise signals determines multiple acoustic waves having different frequencies and intensities which compose the fan noise, and wherein the one or more active noise control units send control signals to a plurality of the transducers to emit transducer acoustic waves substantially matching the different frequencies and intensities of the multiple acoustic waves to reduce or eliminate the fan noise.

4. The computer server room of claim 1, wherein the one or more active noise control units are coupled to one or more server rack controllers for the one or more server racks, the server rack controllers provide information of the identification and status of the plurality of cooling fans to the one or more active noise control units to determine a phase, an intensity and a frequency of the cooling fan noise.

5. The computer server room of claim 4, wherein the one or more active noise control units determine the intensity and the frequency of the cooling fan noise using an established correlation table between the fan speed and the intensity and frequency of the fan noise.

6. The server room of claim 5, wherein the one or more active noise control units send controlling signals to the at least one transducer to emit an acoustic wave that is at about the same frequency and intensity determined by the one or more active noise control unit, but at about 180 degrees out of phase with the cooling fan noise to reduce or to eliminate the fan noise.

7. The computer server room of claim 1, wherein the one or more system racks are assigned to different zones and the one or more active noise control units can activate the one or more transducers in different zones to reduce fan noise in the corresponding zones.

8. A system to control fan noise in a computer server room, comprising:

one or more transducers coupled to one or more exterior walls of a plurality of system racks, the coupling configured to enable the one or more exterior walls to function as diaphragms for the one or more transducers;

one or more active noise control units, wherein the one or more active noise control units send control signals to the one or more transducers to emit a transducer acoustic wave; and a microphone installed near a location in the computer server room where cooling fan noise needs to be controlled, wherein the microphone collects fan noise signals emitted from running fans on the plurality of system racks in the computer server room and send the collected fan noise signals to the one or more active noise control units to allow the frequency and intensity of the transducer acoustic wave to be substantially equal to a frequency and an intensity of the fan noise and at about 180 degrees out of phase with the fan noise to reduce or to eliminate the fan noise;

wherein the one or more active noise control units analyze the collected fan noise signals sent by the microphone to determine the fan noise phase, frequency and intensity;

wherein each of the one or more transducers comprises a fan speed detector that detects which fan on the system rack is running and at what speed, a room sound detector to detects the sound signals received by the microphone, and a transducer controller to issue control signals to the one or more transducers;

wherein the transducer controller comprises a component location sensor, a transducer location identifier, an intensity setting unit, and a phase and frequency setting unit, wherein the component location sensor communicates the locations and status of components on the system rack to a transducer location identifier, the transducer location identifier selects which transducers need to be activated based on the locations and status of components and communicates which transducers have been selected to the intensity setting unit, and the phase and frequency setting unit, the intensity setting unit, and the phase and frequency setting unit receive fan noise signals from the microphone and which transducers have been selected from the transducer location identifier, send controlling signals to the selected transducers to emit acoustic waves.

9. The system of claim 8, wherein the analysis of the collected fan noise signals determines multiple acoustic waves having different frequencies and intensities which compose the fan noise, and wherein the one or more active noise control units send control signals to a plurality of the transducers to emit transducer acoustic waves substantially matching the different frequencies and intensities of the multiple acoustic waves to reduce or eliminate the fan noise.

10. A system for reducing fan noise, the system comprising:

a system rack, the system rack including a plurality of computer systems and a plurality of fans for cooling the computer systems;

a plurality of transducers coupled to one or more exterior walls of the system rack so as to enable the one or more exterior walls to function as diaphragms for the plurality of transducers;

a transducer controller for providing control signals to selected transducers to emit transducer acoustic waves to reduce or eliminate fan noise produced by the plurality of fans, the transducer controller including, a component location sensor for determining the location and status of the computer systems and fans on the system rack, a transducer location identifier for determining the selected transducers based on the location and status of the computer systems and fans, the selected transducers being one or more of the plurality of transducers which are to be activated to emit canceling acoustic waves, a phase and frequency setting unit for determining phases and frequencies of the transducer acoustic waves emitted by the selected transducers; and an intensity setting unit for determining intensities of the transducer acoustic waves emitted by the selected transducers.

11. The system of claim 10, further comprising a microphone for detecting the fan noise at a location where the fan noise is to be controlled;

wherein the phase a frequency setting unit determines the phases and frequencies of the transducer acoustic waves based at least in part on the detected fan noise; and wherein the intensity setting unit determines the intensities of the transducer acoustic waves based at least in part on the detected fan noise.

12. The system of claim 11, further comprising an active noise control unit for analyzing the detected fan noise to determine the fan noise phase, frequency and intensity.

13. The system of claim 12, wherein the analysis of the detected fan noise determines multiple acoustic waves having different frequencies and intensities which compose the fan noise, and wherein the transducer controller sends control signals to the selected transducers to emit transducer acoustic waves substantially matching the different frequencies and intensities of the multiple acoustic waves to reduce or eliminate the fan noise.

14. The system of claim 10, wherein the transducer controller sends control signals to the selected transducers to emit transducer acoustic waves at about 180 degrees out of phase with the fan noise and at an intensity and a frequency substantially equal to the fan noise.

15. The system of claim 11, wherein the system rack is located in a server room; and wherein the microphone is configured to detect the fan noise in the server room.

* * * * *